United States Patent [19]

Scott

[11] Patent Number: 4,784,365

[45] Date of Patent: Nov. 15, 1988

[54] APPARATUS FOR NEST-CASTING OF CONCRETE ELEMENTS

[75] Inventor: Geo A. Scott, Zaltbommel, Netherlands

[73] Assignee: Topland N.V., Aruba, Netherlands

[21] Appl. No.: 41,645

[22] Filed: Apr. 21, 1987

Related U.S. Application Data

[62] Division of Ser. No. 325,185, Nov. 27, 1981, abandoned.

[51] Int. Cl.[4] ..... E04G 11/20

[52] U.S. Cl. ..... 249/21; 249/26; 249/120; 249/158; 249/159; 249/192; 264/297.9; 425/65

[58] Field of Search ..... 264/33, 34, 297.4, DIG. 57, 264/297.9, 333; 249/119, 120, 129, 193, 194, 34, 18, 19, 21, 26, 27, 155, 158, 159, 210, 192; 425/62, 63, 65

[56] References Cited

U.S. PATENT DOCUMENTS

| | | | |
|---|---|---|---|
| 2,314,468 | 3/1943 | Urschel | 425/60 |
| 2,940,152 | 6/1960 | Riehl | 249/194 |
| 3,307,821 | 3/1967 | Torricelli | 249/129 |
| 3,360,231 | 12/1967 | Van Hezik | 249/129 |
| 3,618,181 | 11/1971 | Veale | 425/188 |
| 3,701,508 | 10/1972 | Cross | 249/129 |
| 3,710,534 | 1/1973 | McNamara, Jr. | 264/33 |
| 3,785,608 | 1/1974 | Heinzman et al. | 264/DIG. 57 |
| 3,844,524 | 10/1974 | Fisher et al. | 249/120 |
| 3,847,521 | 11/1974 | Stickler, Jr. | 425/62 |
| 3,859,021 | 1/1975 | Kleiber | 425/186 |
| 4,191,521 | 3/1980 | Muldery et al. | 425/432 |

FOREIGN PATENT DOCUMENTS

| | | | |
|---|---|---|---|
| 152196 | 12/1952 | Australia | 425/63 |

*Primary Examiner*—Jay H. Woo
*Assistant Examiner*—James C. Housel
*Attorney, Agent, or Firm*—Fleit, Jacobson, Cohn & Price

[57] ABSTRACT

Apparatus for nest-casting of generally large elements formed of multiple angular surfaces including a side forming element of concrete useful as a mold form together with a spaced repositioned element mounted also as a side forming element for forming therebetween another side forming element of concrete. Successive operations of cast forming and repositioning the side forming element provide new cast forming structures. Also, the repositioned side forming element is essentially constructed and arranged from an assemblage of interchangeable modular structural components some of which are hingedly connected, adjustable in length, and demountable from the assemblage. Heater elements and vibrating energy sources may be severally applied to the apparatus for compaction of the cast material and accelerating the cast process. The curing of the concrete elements may be enhanced without use of curing compounds by the material containment of said side formed element having a constituency substantially common to the concrete forming element. The elements so formed may be cement elements and also cement-stabilized earth mixes and this use or meaning is contemplated herein by the use of the word "concrete".

6 Claims, 7 Drawing Sheets

Fig. 1
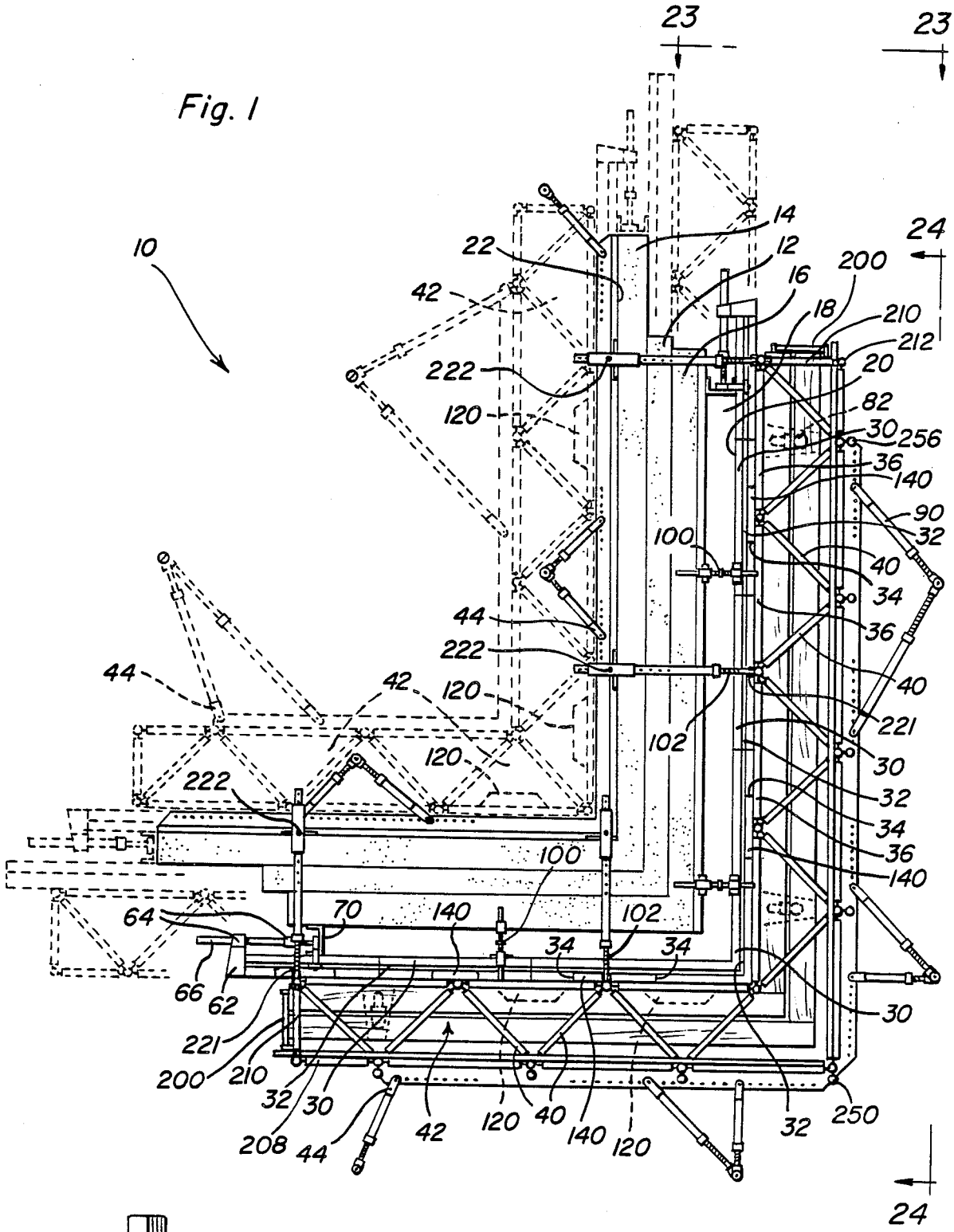
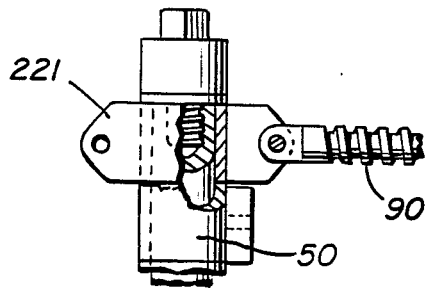
Fig. 9

20
40
42
44
60
62
64
66
70
74
80
82
86
88
90
114
118
200
256
4

88
60
221
102
222
86
40
40
42
94
256
x
254
74
90
92
94
260
262
240
42

88
88
208
210
220
202
210
224
210
221
220
210
86
220
102
54
221
220
208

102
62
64
66
208
200
62
64
66
54
86
210
88
88
212
42
221
210

APPARATUS FOR NEST-CASTING OF CONCRETE ELEMENTS

This application is a division, of application Ser. No. 325,185, filed Nov. 27, 1981, now abandoned.

BACKGROUND OF THE INVENTION

The present invention relates to casting of panels in successive or sequentially formed self-forming mold forms and more particularly the invention is directed to casting of concrete wall elements formed and molded directly against a previously cast element on the side and with a spaced repositioned element on the other side.

1. Field of the Invention

The apparatus and method of the invention provide for use of a folded concrete element as a stable molding form against which to cast another element employing only one-half of the form otherwise required and successively or subsequently casting another similar element against a previous folded concrete element using only a half form without dismantling the same and including means for its movement after a cast concrete element is set so that it in itself forms a mold surface. Included in forming the half form are a series or system of triangulated supporting structures composed of a rigid assemblage of interchangeable modular structural elements securely hinged to each other forming a half form while a mold facing previously molded and cured forms the other mold side. The ends are formed by modular section that are reciprocably or parallelly adjusted along a given dimension at the ends of the mold form and thus repeated casting of an indefinite variety of nestable wall elements as well as repeated castings of a predetermined wall element are provided, in any of the general forms of "I", "L", "M", and "N" as well as any conventional zigzag form. Other and further details that are provided in forming the casting element are included and described in further detail below, such as providing compaction by a vibrator element, heating means for accelerating the curing process, wheel mountings on the half frame or form structures hydraulically controlled as well as the concept of providing demolding oil, wax, rubber and the like between layers of panels and concrete molded elements formed in their nesting relation.

2. Description of the Prior Art

Concrete precast elements for walls, floors and composite sections of buildings, whether flat-shaped or of folded shapes and constructions involving slabs jointed end on end and at an angular relation into a common or singular element such as in the form of an "L" have been known to be cast in batteries, that is, a simultaneous casting process or simulcast. Such batteries consist of molds made of several horizontally spaced upstanding shutter rings or mold forms temporarily secured to each other for casting of the concrete therein and which are subsequently detached for allowing removal of the cast concrete elements. One such known structure is a battery of molds shown in the Cross patent listed below. Another patent of some interest having pivotal end members for the assembly of concrete blocks is Torricelli. Such various disclosures as are known are shown by the representative U.S. Patents listed as follows:

U.S. Pat. No. 2,314,468—W. E. Urschel,
U.S. Pat. No. 3,307,821—D. Torricelli,

U.S. Pat. No. 3,618,181—M. E. Veale,
U.S. Pat. No. 3,701,508—Walter Peter Cross,
U.S. Pat. No. 3,844,524—Howard M. Fisher et al,
U.S. Pat. No. 3,859,021—Armin Kleiber,
U.S. Pat. No. 4,191,521—Hendrikus Muldery.

Whether taken singly or viewed in combination with each other, none of these patents is believed to have a bearing on the patentability of any claim of this invention.

SUMMARY OF THE INVENTION

A primary and significant object of the present invention is to provide method and apparatus of casting concrete element of the folded type, as well as simple slab elements, such as by casting a subsequent panel directly upon and against a previously cast element for one side of the mold and using a same set of form or forms, herein called "system forms" for completing the mold cavity for such castings. Thus a cast product is to be formed having a contoured surface form generated on one side by surface forming means that is to form an image of the contoured surface form on the other side of the product.

Another object of the present invention is to provide a method and apparatus forming concrete elements in sequence where there is provided a surface forming member generating one side of a contoured element and an image surface member generated by the surface forming member forming the other side of the contoured element.

Yet another object of the present invention is to provide structural concrete elements in which there are contoured surfaces disposed to have a plurality of vertically defined planes.

A further object of the present invention is to provide vertical end stops for closing off ends between a form defined by a contour surface forming member and a contour image surface forming member and in which the vertical end stops adjustably pass through parallel planes until a desired dimensional position is achieved.

An additional object of the present invention is to provide stiffening structures for end stops that improve the method and construction of large concrete elements according to the present invention.

Still another object of the present invention is to provide by vibration the compaction of the casting material as it is cast in the forms.

Another and additional object of the present invention is to provide heating structures and methods for improving the curing of the cast material, improved methods of feeding the material into the contoured forms, providing spacer elements and support structures comprising an assemblage of interchangeable modular structural components some of which are hingedly connected, adjustable in length, threadedly engaging each other, and demountable from the assemblage.

An object of the invention also is to provide a coating of form oil between the image contoured surface and the cast element so that the cast element is not adhered or cohered onto the image contoured surface material.

An additional and further object of the invention is to provide a hydraulic ram system with retractable wheel assemblages for moving the contoured surface forming means away from a set cast element for inspection and also to reposition it for sequential casting where the contoured surface member is then used for a new side of a cast element while the previously formed cast element provides an image surface contour forming another side of the cast form.

Particularly, it is an object an advantage and feature of the present invention to provide surface forming means generating a side of a contoured element and a contoured image surface means generated by the surface forming means forming the other side of the contoured element.

Another object and advantage of the invention is to obviate over the prior art method and apparatus of casting elements in arrays or batteries even though such battery casting affords good designed dimensioning, high and rapid production and, some economic features; known battery casting provides disadvantages that are not present in the practice of the invention. Less space and movement of equipment for concrete casting of elements is available in the present invention since there is no dead space disposed between individual concrete elements formed by the sequence formed structures. Battery arrangements also have the disadvantage that the molds are not capable of being rapidly and easily alterable so dimensions of the resulting concrete element may be varied if desired. Battery assemblies are not easily mobile and access to the concrete element so formed is often difficult. The sequential arrangement of a one-contoured form surface for construction of concrete elements against a mirror or image of a previously contoured surface by means of an assemblage of the present invention provides more uniformity, improved strength and dimensional characteristics of the final concrete product.

It is an object and advantage of the present invention to provide an arrangement or assemblage of forms called a "system form" that enables one to provide a sequential set of formed concrete elements. This is a method of nest-casting and is uniquely adapted for contoured and folded type of concrete constructions for walls and similar structural components.

A final and additional object of the present invention is to provide a system of forms, thoroughly flexible and versatile for allowing a great variety of shapes, dimensions and contour surface finishes of a sequence or nesting of precast elements, each of which is used as part of a cast for a nest formed concrete element. The "system forms" are fractionalized and modularized into standard interchangeable components and supporting an adjusting configurations of the structure forming the mold facings.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE SEVERAL VIEWS OF THE DRAWINGS

FIG. 1 is a plan view of a concrete casting assemblage illustrating method and apparatus for nest casting of concrete elements according to a preferred embodiment and best mode of the present invention.

FIG. 9 is a detailed view of an assembly coupling system.

DETAILED DESCRIPTION OF THE PREFERRED EMBODIMENTS

Figures 2, 8, 10:
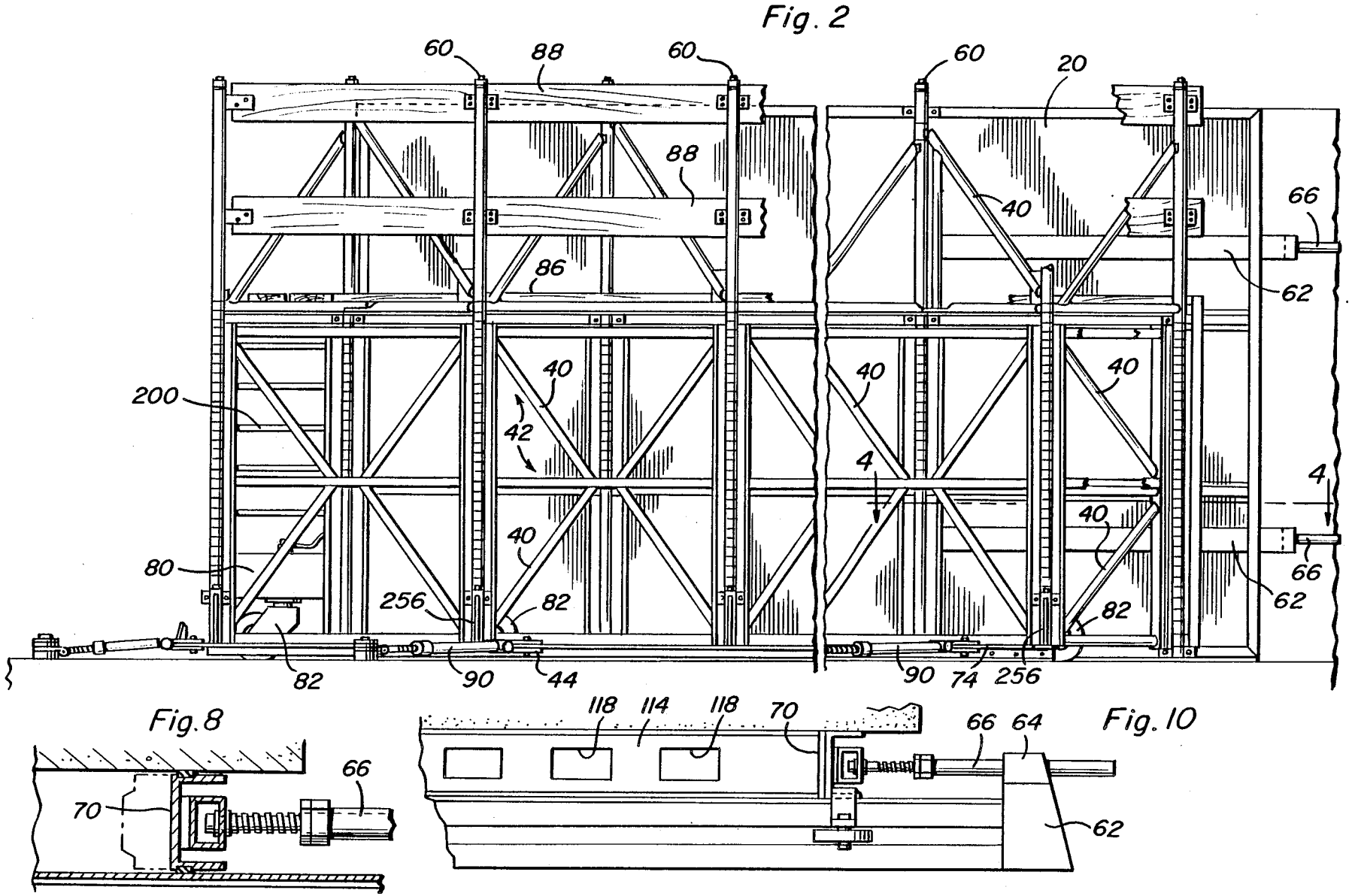
FIG. 2 is an elevational view of a side taken on an enlarged scale.
FIG. 8 is a plan view with portions in section on an enlarged scale of an end stop assembly.
FIG. 10 is in an enlarged view of an inclined top mold having apertures for pouring concrete material therethrough.

Referring now to the drawings, there is shown apparatus 10 for casting a nest of panels of generally large concrete elements, concrete elements 12, 14, 16 having previously been cast and, as shown in FIG. 1, a mold cavity or space 18 is formed in which another concrete element will be formed. Nest casting of these concrete elements may proceed as shown from a cast concrete element 12 and the sequential process of casting elements 14 and 16 proceeding on each side thereof previously cast concrete element 16 forms one side of the mold cavity 18 for casting a concrete element while a sequentially repositionable mold cavity 18 20 forms the other side of the mold form. Sequentially repositionable mold form 20 previously had formed concrete element 12, 14, 16 and now forms on side of the mold cavity 18 for a concrete element to be cast. Similarly, folded concrete 12 which is shown as an L-shaped configuration, but may as well be an I, M, N, zigzag, flat, or other configuration was formed by using two forms 20 and 22 and each form cooperated with element 12 when forming concrete elements 14 and 16 and forming one side of the mold form therefor. This process is continued as will be described hereinbelow for nest casting generally large concrete elements, particularly the several concrete elements configured as I, L, M, N, or other flat or zigzag configurations. Form 20 is initially used together with form 22 to mold a first concrete element 12. Subsequently, forms 20 and 22 are relocated to mold a subsequent concrete element, or elements.

Figure 3:
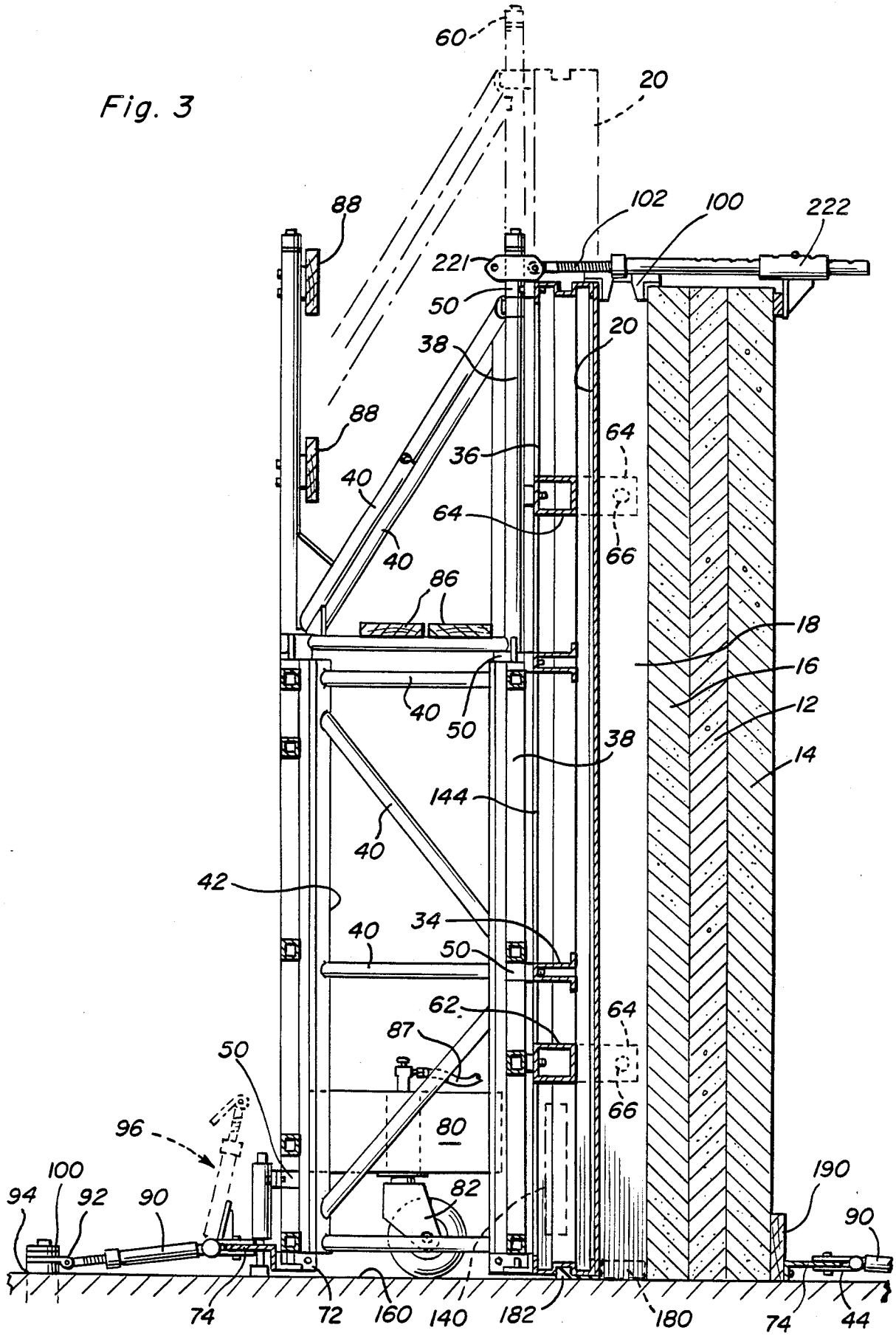
FIG. 3 is a sectional view of the embodiment shown in FIG. 2 but on an enlarged scale.
Figure 12:
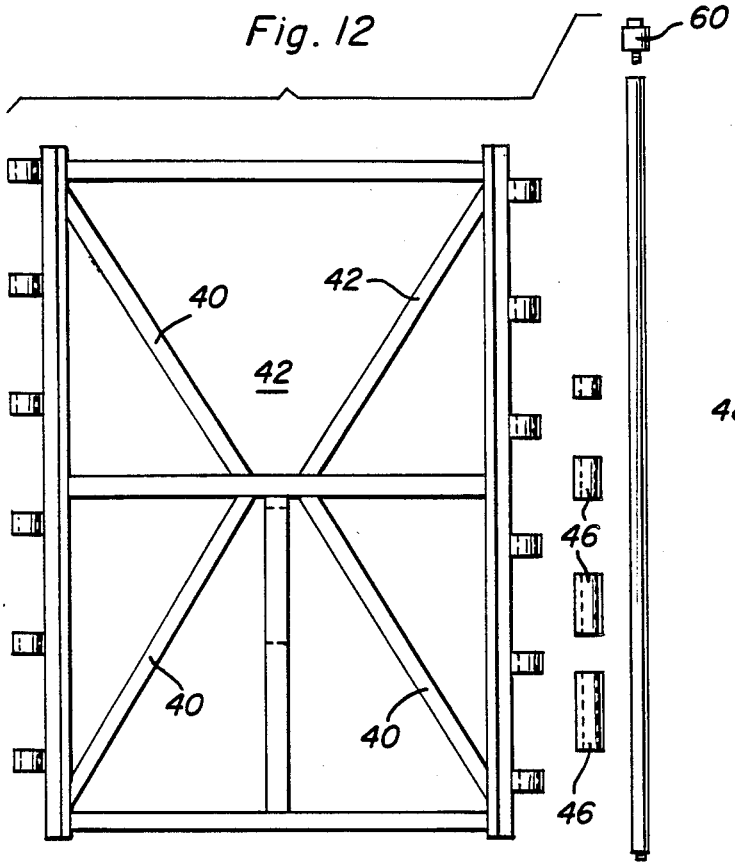
FIGS. 12–18 are detailed view showing component assemblage elements some of which are interchangeable modular structural components, some of which are hingedly connected, adjustable in length, and demountable from the assemblage as desired.
Figure 13:
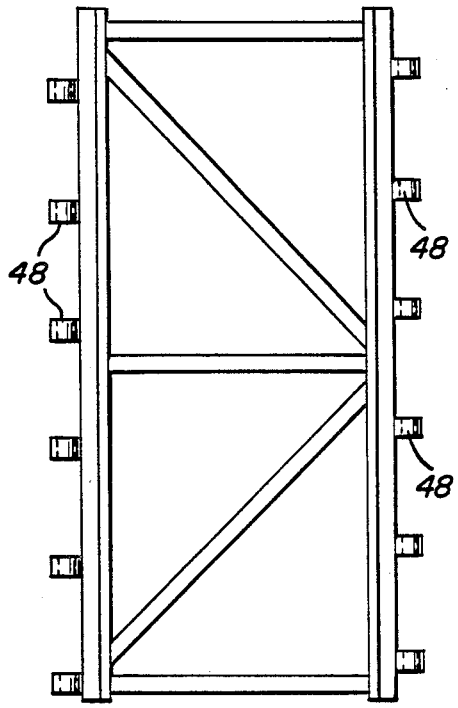
Figure 14:
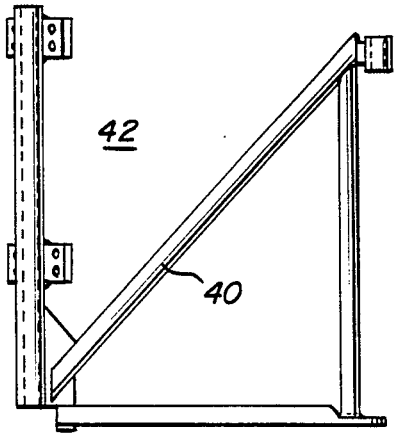
Figure 15:
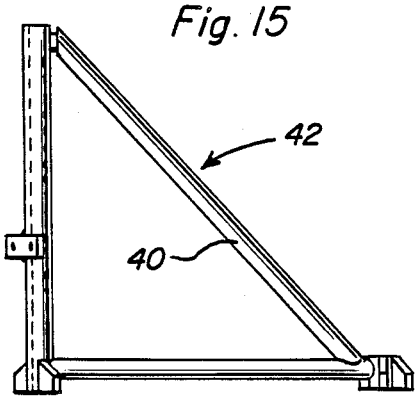
Figure 16:
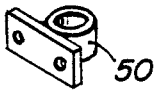
Figure 17:
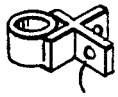
Figure 18:
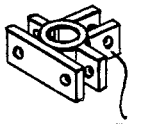

The mold form 20 include a series of mold facings or sheet steel facings 30, behind which there may be provided cold rolled stiffeners 32 held in place and supported by stiffener beams or frames 34 as is particularly shown in FIGS. 1 and 3. Secured behind these frame structures are further framing supports and structures 36 and are held in place by stays 38 and stays 40 which may comprise a triangulated support frame or stays 42 and which may be connected by a hinged clevis 44. The structures of stays 42 may be of various constructions and design as particularly shown generally in FIG. 2 and more specifically in FIGS. 12–15. Spacers 46, pivot receiving elements 48 and pin receiving elements 50, 52, 54, are exemplary shown in FIGS. 16–18 for receiving shafts or pins 60 shown in FIG. 12.

Also supported as part of the frame 34 is a retainer beam 62 having its swivel head 64 and a rotating jack screw 66, which provide support for end casting form structures 70 as shown in each end of the mold cavity 18.

A perforated stiffening beam 74 is shown supported from a foot attachment fitting 72 shown in FIG. 3 and the entire assembly 10 is raised by a beam supported hydraulic ram 80 shown connected to hydraulic lines 87 in FIG. 3. The hydraulic ram 80 is supported by a swivel wheel assembly 82.

The stays 38 support in horizontal relation any number of walking support surfaces or walking planking elements 86 which are cooperatively disposed with safety railings 88. The base floor or shoe fittings 72 are precisely held in stabilized position by an arrangement including a jack screw 90 coupled to a hinged hasp assembly 92, all of which may be raised temporarily from the anchored position shown in FIG. 3 when the hydraulic ram 80 and swivel wheel assembly 82 is capable of removing or displacing the mold form outwardly to a new given or predetermined position. The hinged hasp assembly 92 is connected to an anchor assembly 94.

Figure 6:
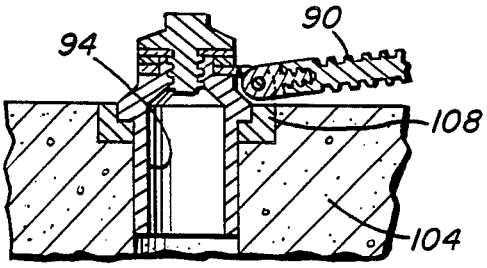
FIG. 6 is a sectional view taken along line 6—6 of FIG. 5.
Figure 7:
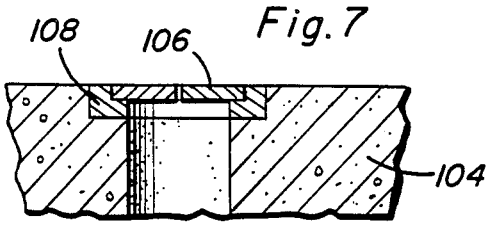
FIG. 7 is an alternate detailed view of the assembly shown in FIG. 6.

Jack screw spacer arrangements 100 are separately provided as shown in FIGS. 1 and 3, among other Figures, so that a top fixed relationship that corresponds with the fixed relationship of the anchor assembly 94 is similarly achieved as desired for maintaining precise dimensional relationships. Anchor details are shown in FIG. 6 and when an anchor arrangement is not in use or needed, the assembly 94 is removed from fixed position 104 and a cover plate 106 is placed to hide or cover the opening left by the anchor assembly.

Figure 11:
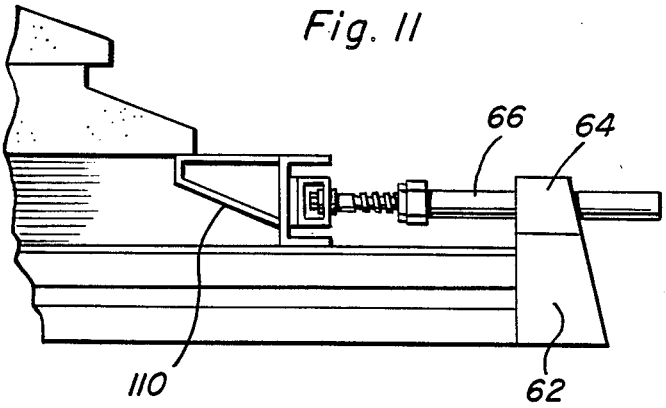
FIG. 11 is a detailed view showing a modification of an arrangement shown in FIG. 8 for constructing a series of contoured end stop surface elements.

Modification of an end stop assembly is shown by end stop assembly 110 in FIG. 11 having a similar type retainer beam 62 and a swivel head 64 with a rotating jack screw 66.

Where a top surface of a cast element cast in mold cavity 18 is designed to have a nonlevel resulting surface, an initial former 114 shown in FIG. 10 is provided so that concrete is cast and poured therein by pumping, such as through a canvas chute (not shown), elephant trunk or the like, extending so that the pouring device is extended as deeply into the mold as possible to overcome splashing and clinging of concrete from removing the molding oil, wax or the like, as described below, which is applied to the forming surfaces. The oil or wax performs its function and is not removed which would occur quite easily by splashing the structure with the poured concrete. While the concrete is increasing in depths during pouring within the mold cavity 18, external vibratory mechanisms or vibrators 120 are activated to insure compaction and early settling of the wet concrete so that an excellent surface finish is achieved, even though the fresh concrete is fairly thick. Thus a satisfactory concrete surface finish free of depressions is produced. Within the frame arrangement and stays 42 and interspersed at variously desired distances apart throughout a length of the form 20, there are a plurality of heater assemblies such as electric or gas operated heaters 140. Convection and radiated heat energy are applied against the metal forms, the heat being applied during molding and allowed to rise between the stiffeners, which may be directed along a controlled path by an insulating canvas 144, FIG. 3, fastened to a rear and top arrangement of a mold facing section so that hot air is distributed and energy is transferred in the form of heat unto the metal form. Because of the nature of sequential molding to be performed by the mold structure 20, it is possible that the arrangement of heaters 140 and the canvas 144 are not removed during the restaging of the form 20.

Figure 19:
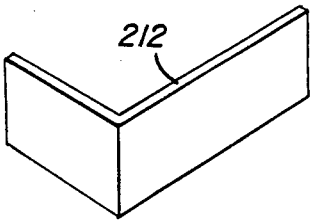
FIGS. 19, 20 and 21 are perspective view showing concrete elements of configurations attained by the method and apparatus of the present invention.
Figure 20:
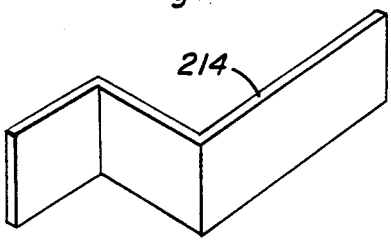
Figure 21:
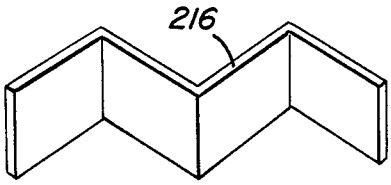
Figure 22:
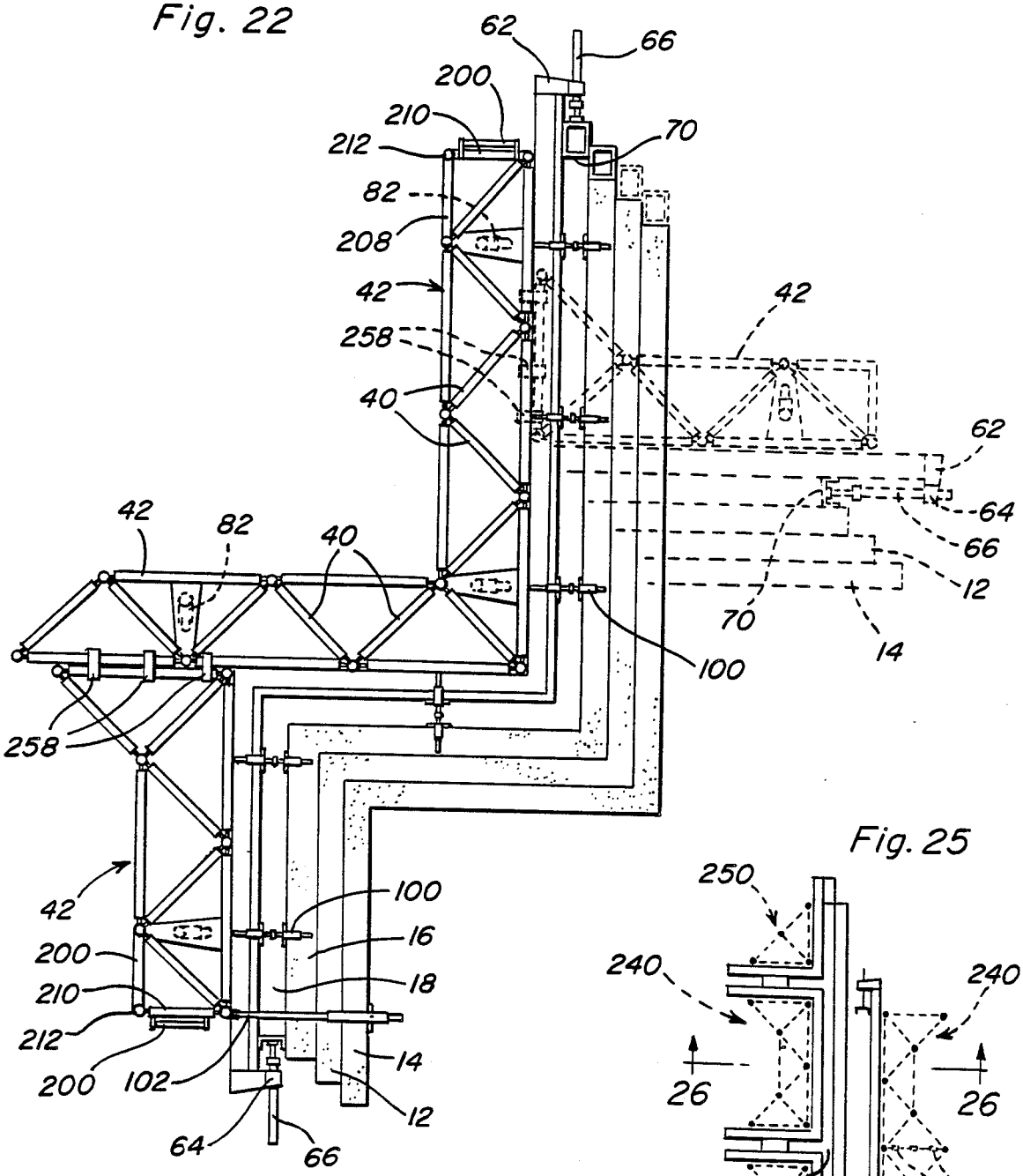
FIG. 22 is a plan view similar in some features to the plan view of FIG. 1 but illustrating the method and apparatus of the invention for nest casting of concrete elements in the shape of "N" and "M", respectively.
Figure 25:
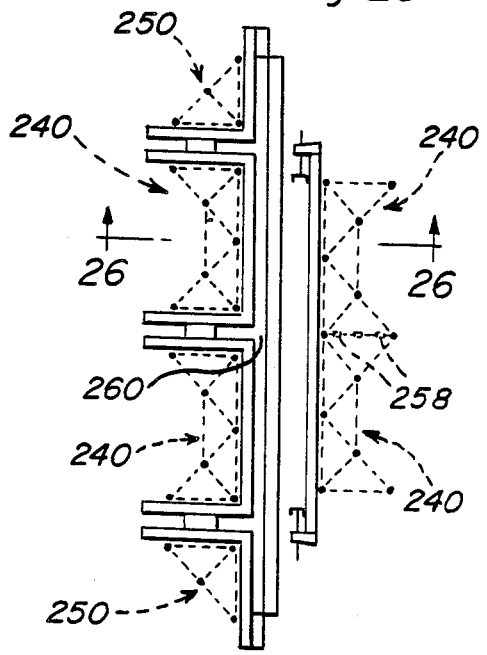
FIG. 25 is a plan view showing the casting of an inclined assembly and for casting flat elements.
Figure 26:
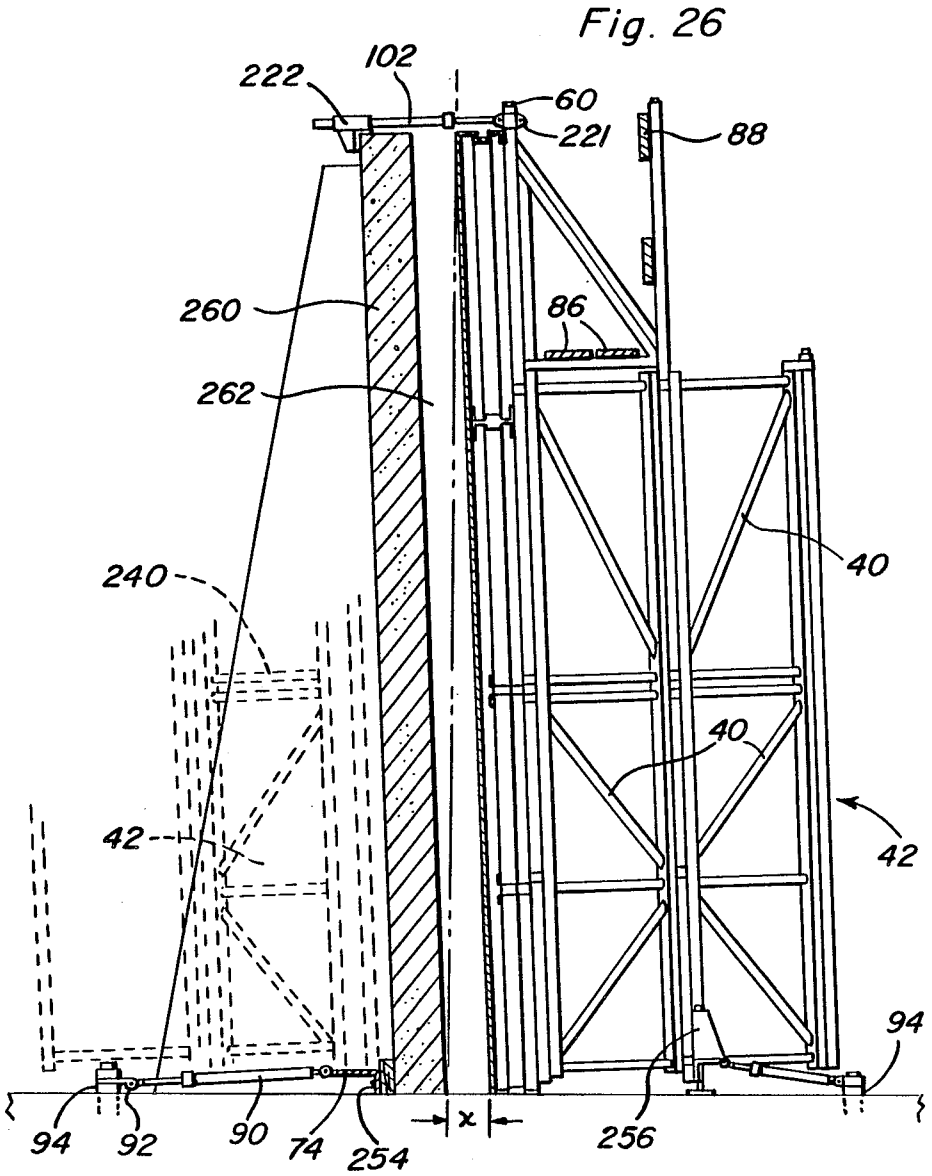
FIG. 26 is a sectional view thereof taken along lines 26—26 of FIG. 25.

The system of the present invention is capable of being used to precast flat I-shaped panels and even relatively large floor slabs where they are erected in a verticalor generally vertical array. As has been referred to above, it is appreciated that the system of cement forms and uses of the present invention may be used to form the various constructions, shapes or sizes of I, L, M, and N or zigzag configurations 212, 214, 216 illustratively shown in FIGS. 19, 20 and 21. Also, it is within the purview of the invention to provide that the assemblies may be staged at a slight inclination from the vertical. This form of the invention is illustrated and described in connection with FIGS. 25 and 26. It is also appreciated that the elements formed in mold cavity 18 need not be finished at the top at an exact level orientation of the mold facing and can therefore by screeded at a lower level whether horizontal or even slightly inclined. It is further seen that nested elements 12–16 are finished at the top by screeding flush with the tops of the preceding elements, such tops providing further a convenient area to stand or work from. An element can be cast on a base elevated from and supported upon a base floor 160 (FIG. 3) and fitting in the casting cavity, so that such element, while matching the nest top may be of less height if desired than other elements of the same nest. New concrete against a freshly cast element tends to maintain to a higher degree of both water and heat in the elements, thereby enhancing a proper curing without the use of special curing compounds or other conventional and routine methods of the prior art.

It should be noted that before the pouring and dispensing of the concrete mix into the forms, that the prior or image mold for is prepared throughout its surface by being treated with release oil applied by brush or spray. The casting face of the form 16 is coated with form oil or wax, the floor area in front of the assembly being likewise treated with oil or wax. The materials which may be used for this purpose are demolding oil or soft wax and the like which is extended to such widths that it will be covered throughout by a bottom seal to form a bottom for mold cavity 18.

Figure 4:
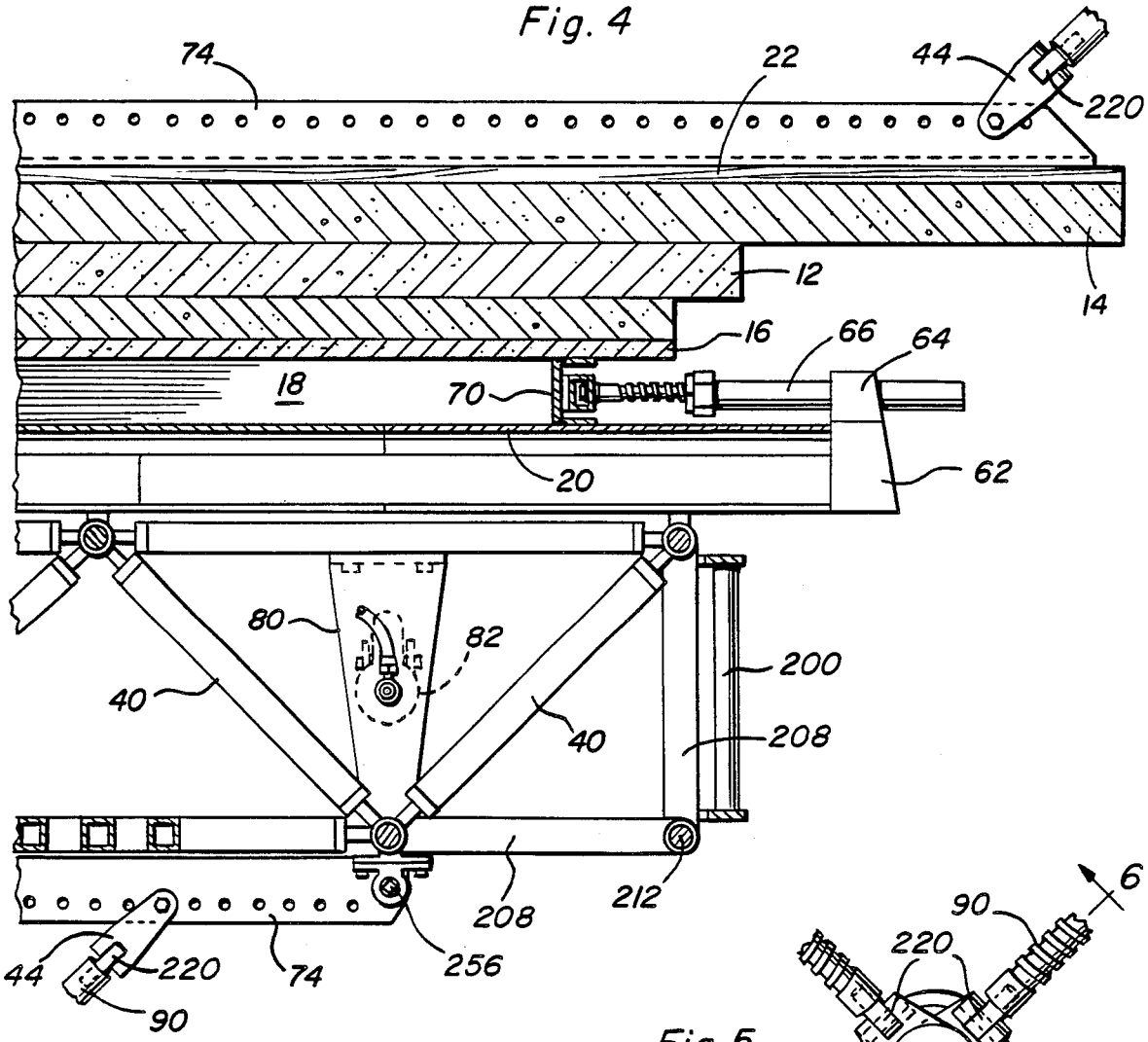
FIG. 4 is an enlarged sectional view taken along line 4—4 of FIG. 2.
Figure 23:
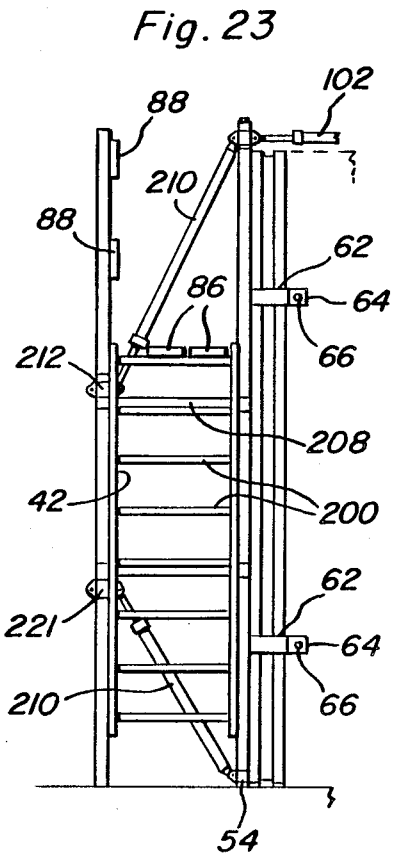

A few hard rubber or wooden blocks 180 are set on the floor against the elements 16, 12 and 14 preventing them from being accidentally moved when the mold form 20 is rolled into position in front of the them and after removal of the safety blocks, if desired, the form 20 is slowly pushed within millimeters of its final posiiton. The arrangement is then connected to the anchor assembly 94 and the form 20 is then lowered onto the base floor 160 thereby tightly compressing the bottom seal 182 as well as the seal under the end stop assembly. This assembly is then slowly moved into its final position by adjusting the jack screw 90 while keeping a correct and proper distance between the mold for 20 and element 16, 12 and 14 by removable spacers at the bottom and with the jack screw spacers 100 along the top shown in FIG. 3. The jack screws 102 and their corresponding bracket assemblies are installed on the fittings 38, 40 and are operated to secure the form 20 and elements 16, 12 and 14 in spaced relation and squeezing any seals along the end stop assemblies 70. Stiffening assemblies associated with the connection between jack screw 102 and fitting 38, 40 are then tightened by actuating jack screws 210 shown associated with members 212, and ladders 200 shown in FIGS. 4 and 23 are installed. Spacer blocks at the bottom of the mold cavity may then be removed and this completes the readiness of the mold cavity for receiving concrete for casting in the mold cavity 18.

Concrete used is of relatively high strength such that compaction by the vibrators insures full contact of the concrete with all surfaces of the forms resulting in the satisfactory concrete surface finish free of depressions. The concrete can be fed by skip from above through a hopper or by pumping. While the concrete continues to be poured, vibrators and heater elements are activated as necessary to insure perfect casting. When the concrete being cast reaches near the top of the form 20 and element 16, 12 and 14, screw jacks 102 remain firmly in place until stripping is being performed and spacer 100 may be removed and the top of the cast element is then screeded at a required or desired level. When the concrete has sufficiently set and hardened, the stiffening assemblies of connections are respectively slackened by actuating corresponding jack screws 210, and corresponding brackets being released, removed or rotated and then the form 20 is removed. This is referred to further in connection with FIGS. 22–26.

Jack screws closest to being perpendicular to the mold are loosened enough that their hasp may be removed from the anchor assembly 94 and these jack screws are then rotated above the clevis and brought to rest in their non-active position. Subsequently, the remaining jack screws 90, more or less set at 45° to the mold, are then activated so as to pull the form assembly, sliding it on the floor a few millimeters. Once the assembly is sufficiently freed from the concrete element that has been cast, it is raised by depressing the wheel assemblies 82 while disengaging the last jack screws 90 from the anchor assemblies and folding them to non-active position. The form assembly is then rolled away, thoroughly cleaned and prepared for casting the next concrete element.

The operation of cleaning the surfaces and preparing for another casting may include first an inspection of the newly stripped concrete element surface for possible defects such as cavities formed by entrapped air bubbles, slight honeycomb effects or any other defects which in the first instance should have been avoided. Such defects, if any, are carefully corrected with an application of cement grout finished by steel trowel or putty knives, following the hardening of which the concrete surface is thoroughly brushed or preferably vacuum cleaned and coated with a quick setting cement slurry applied preferably with a rubber squeegee to fill up all minute cavities or seal the pores of the cast element surface. Then prior to the next and sequential step of molding, the surface is prepared by an oil or wax being applied thereupon. If the next element is to receive reinforcing steel, lifting lugs, blocking for lift hook cavity or to include prescribed contrivances such as electrical conduit, electrical boxes, templates, template mounted piping assemblies or the like to be be embedded therein, these are fitted into mold form 20 after the surface of the mold form has been properly oiled.

Building elements are cast such that the initial and starting building element is the largest element and sequentially the elements are progressively cast to smaller sizes as is consistent with established general production schedules. Once the nest becomes sufficiently heavy to withstand thrust of the concrete, the initial former is relocated on the base floor and set on a felt pad cut flush with the casting surface of the former, which is subsequently strutted at the reverse face by wooden blocks 190 which may be attached to the stiffening beam 74 being held by jack screw 90 anchored to the assemblies 94. In this manner, a new nest is started.

As nests are increasing at one end, the older or oldest elements at the other end, insofar as needed, are removed by whichever moving device is available and immediately set on trailers, for example, and then directly transported to their ultimate erection site. It is appreciated that in this process there is no storage handling at all, while the storage as well as curing occur at not additional expense within the nest which in turn require the smallest possible grouping area for this comprehensive single production, curing, and stocking process.

In permanent or semi-permanent installations, the lifting devices are preferably movable by gantries on rails or the like. For less permanent installations including the fortuitous temporary utilization of floors of buildings at the project site, the lifting of building elements as well as relocating the initial former is done by mobile cranes.

Lifting may generally be required and is realized by means of spread beam with close perforations serving to engage upper hooks of lifting chains with lower hooks strung through the lifting lugs of the formed elements 12, 14, and 16. The lifting lugs are cast in a vertical plane, passing through the center of gravity of the elements, members so cast that the latter may be lifted and most importantly be then set, in a perfectly vertical position. The distance between the lugs are so arranged and constructed between the perforations of the spread beam that the lifting chains also are nearly vertical during the lift while the main hook of the crane is on a vertical through the center of gravity of the total element. The removal of an element can be further aided at the moment of lifting by pushing or pulling such element sidewise using a lever pinned into the orifice of a cover plate 106, which orifice is in the first instance intended for removal of the cover from the collar 108.

Figure 24:
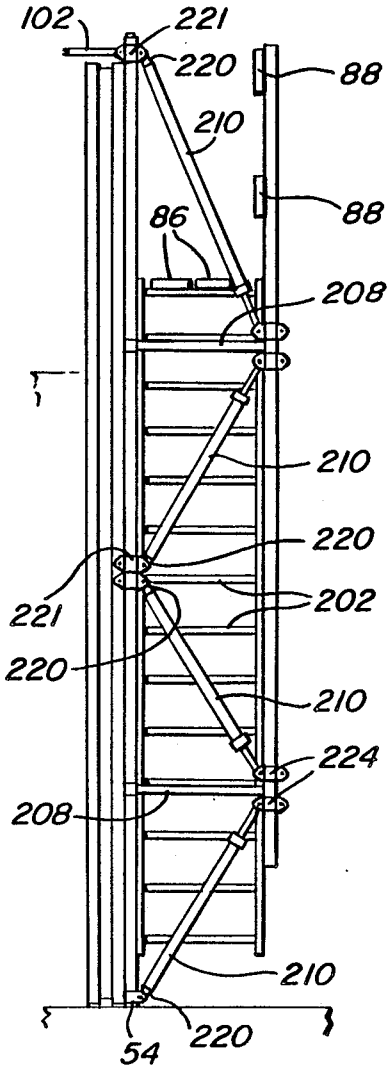
FIGS. 23 and 24 are sectional views taken along lines 23—23 and 24—24, respectively, of FIG. 1 and contain details of stiffening assemblies.

The illustration of stiffening assemblies including stays 208 such as in FIGS. 23 and 24 are totally flexible and adjustable and allow for usage of additional jack screws 210. The stiffening assembly also carries the ladder 200. A longer ladder 202 is required for use in FIG. 24.

Figure 5:
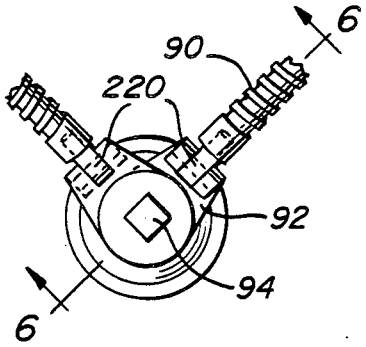
FIG. 5 is an enlarged view of a detail of an assembly connecting two various components of a main structural frame.

The jack screws are generally of the same construction throughout where possible. They are composed of the jack bolt and a corresponding short initial body section having at one end a quick acting screw-and-lock nut combination and at the other end a standard threaded cavity for enabling the jack body to be lengthened by one or more extension sections likewise provided with a standard threaded cavity and at the other end a threaded pin fitting the standard cavity. The combination allows the initial jack body and the extension bodies to be coupled to each other as well as to the hinged clevis 44 by a tailend 220, as shown in FIG. 5 or any similar fittings. The jack bodies are also perforated in order to be keyed to fitting 221 or bracket 222, or the swivel head 64, or the like.

It is further appreciated that the system of the method and apparatus of the invention and new form of casting is also used to precast flat "I" panels even for relatively large floor slabs. As a way of example, form assemblies 240, 250 are staged at a slight inclination 'x' from the vertical, see FIGS. 25 and 26. The mold facing assemblies are set on a face spreader 254 while the screws 256 are adjusted to fully bear the form assemblies and anchorage to the base floor is realized in the manner described above. A matching form assembly composed of a number of assemblies 240 fastened to each other by clamps 258 (FIG. 22) and attached to the earlier staged assemblies to cast the buttressed initial former 260 which in turn is used to precast other building elements 262 and so on, each stably leaning on the other. Removal of these flat elements, contrary to the other folded nestable elements, is only possible after the last element of the nest is sufficiently cured and hardened, which is a slight disadvantage, however, amply compensated by the fact that the generally extremely heavy initial former 260 need not be relocated. The same manner of fastening structural assemblies 38, 40, 42 (FIG. 22) by the clamps 258, allows composition of complex total form structures, such as the "M" or "N" form structures of FIG. 22 as well as the accompanying scaffoldings, if needed. Such assemblies can be clamped together at desired positions such as by clamps 258, thus infinitely varying the dimensions of the members of the structures "M", "N" or for any zigzag shaped element.

It is seen that the concept of the invention provides for constructing and making a product of folded concrete elements which in turn may be used as stable forms against which to cast other and sequential concrete elements employing only one-half of the form that would otherwise be required and of subsequently casting other similar elements against each other in such a manner to form a nest using only half forms without dismantling the same.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for nest-casting concrete panels comprising a substantially flat horizontal supporting surface, a first vertically disposed mold form on said supporting surface and including a substantially flat mold surface forming a first side wall of a mold cavity, a second vertically disposed mold form on said supporting surface and including a substantially flat mold surface forming a second side wall of a mold cavity, a pair of vertically disposed end mold forms on said supporting surface, each end mold form including a substantially flat mold surface forming end walls of a mold cavity, the lower ends of said mold forms engaging the supporting surface in a manner to retain concrete placed in the mold cavity while it cures to form a concrete panel, said second mold form including means in movably supporting engagement with the supporting surface for movement of the second mold form to spaced relation to a first formed concrete panel to form a second mold cavity, said end mold forms being mounted on said second mold form for movement therewith, said means supporting said second mold form including vertically adjustable wheeled means mounted on said second mold form and engaging said supporting surface to enable movement of the second mold form in any direction in relation to the first mold form and first formed concrete panel, said second mold form including means at the upper edge thereof adjustably connected to the upper edge of the first formed and subsequently formed concrete panels for maintaining the thickness of the upper end portion of the mold cavity.

2. The apparatus as defined in claim 1 wherein said end mold forms are adjustably mounted from the end edge portions of said second mold form for lateral inward and outward movement in relation to the flat mold surface on the second mold form to vary the width of the concrete panels.

3. The apparatus as defined in claim 1 wherein said wheeled means supporting the second mold form includes laterally spaced wheels engaging the supporting surface and vertically adjustable means connecting the wheels to the second mold form to vertically elevate the second mold form to enable free movement in relation to the supporting surface with the vertically adjustable means enabling the second mold form to be lowered into contact with the supporting surface after adjustment to form a second and subsequent mold cavities.

4. An apparatus for nest-casting concrete panels comprising a substantially flat horizontal supporting surface, a first vertically disposed mold form on said supporting surface and including a substantially flat mold surface forming a first side wall of a mold cavity, a second vertically disposed mold form on said supporting surface and including a substantially flat mold surface forming a second side wall of a mold cavity, a pair of vertically disposed end mold forms on said supporting surface, each end mold form including a substantially flat mold surface forming end walls of a mold cavity, the lower ends of said mold forms engaging the supporting surface in a manner to retain concrete placed in the mold cavity while it cures to form a concrete panel, said second mold form including means in movably supporting engagement with the supporting surface for movement of the second mold form to spaced relation to a first formed concrete panel to form a second mold cavity, said end mold forms being mounted on said second mold form for movement therewith, said means supporting said second mold form including vertically adjustable wheeled means mounted on said second mold form and engaging said supporting surface to enable movement of the second mold form in any direction in relation to the first mold form and first formed concrete panel, horizontal adjustment means interconnecting the second mold form and the supporting surface at a point spaced from the wheeled means to enable movement of the second mold form toward and away from the first mold form and toward and away from a first formed concrete panel and subsequently formed concrete panels to rigidly secure the second mold form in adjusted position.

5. The apparatus as defined in claim 4 wherein said second mold form includes a seal strip of resilient material along the lower end thereof for sealing engagement with the supporting surface to form a seal between the movable second mold form and the supporting surface.

6. An apparatus for nest-casting concrete panels comprising a substantially flat horizontal supporting surface, a first vertically disposed mold form on said supporting surface and including a substantially flat mold surface forming a first side wall of a mold cavity, a second vertically disposed mold form on said supporting surface and including a substantially flat mold surface forming a second side wall of a mold cavity, a pair of vertically disposed end mold forms on said supporting surface, each end mold form including a substantially flat mold surface forming end walls of a mold cavity, the lower ends of said mold forms engaging the supporting surface in a manner to retain concrete placed in the mold cavity while it cures to form a concrete panel, said second mold form including means in movably supporting engagement with the supporting surface for movement of the second mold form to spaced relation to a first formed concrete panel to form a second mold cavity, said end mold forms being mounted on said second mold form for movement therewith, said means supporting said second mold form including vertically adjustable wheeled means mounted on said second mold form and engaging said supporting surface to enable movement of the second mold form in any direction in relation to the first mold form and first formed concrete panel, said second mold form including a rigidifying framework extending therefrom opposite the flat molding surface with said wheeled means being connected to the framework, said second mold form including means at the upper edge thereof adjustably connected to the upper edge of the first formed and subsequently formed concrete panels for maintaining the thickness of the upper end portion of the mold cavity, said wheeled means supporting the second mold form including laterally spaced wheels engaging the supporting surface and vertically adjustable means connecting the wheels to the second mold form to vertically elevate the second mold form to enable free movement in relation to the supporting surface with the vertically adjustable means enabling the second mold form to be lowered into contact with the supporting surface after adjustment to form a second and subsequent mold cavities, horizontal adjustment means interconnecting the second mold form and the supporting surface at a point spaced from the wheeled means to enable movement of the second mold form toward and away from the first mold form and toward and away from a first formed concrete panel and subsequently formed concrete panels to rigidly secure the second mold form in adjusted position, said second mold form including a seal strip of resilient material along the lower end thereof for sealing engagement with the supporting surface to form a seal between the movable second mold form and the supporting surface, and means on the framework spaced from the wheeled means and engageable with the supporting surface to stabilize the second mold form by providing spaced supporting points of engagement between the second mold form and the supporting surface.

* * * * *